US007391879B2

(12) United States Patent
Beer et al.

(10) Patent No.: US 7,391,879 B2
(45) Date of Patent: Jun. 24, 2008

(54) LOUDSPEAKER

(75) Inventors: Daniel Beer, Martinroda (DE); Berthold Schlenker, Ilmenau (DE); Sandra Brix, Ilmenau (DE); Thomas Sporer, Fürth (DE)

(73) Assignee: Fraunhofer-Gesellschaft zur Foerderung der angewandten Forschung e.V. (DE)

( * ) Notice: Subject to any disclaimer, the term of this patent is extended or adjusted under 35 U.S.C. 154(b) by 271 days.

(21) Appl. No.: 11/046,123

(22) Filed: Jan. 28, 2005

(65) Prior Publication Data

US 2005/0157905 A1 Jul. 21, 2005

Related U.S. Application Data

(63) Continuation of application No. PCT/EP03/09036, filed on Aug. 14, 2003.

(30) Foreign Application Priority Data

Aug. 16, 2002 (DE) ..... 102 38 325

(51) Int. Cl.
*H04R 1/00* (2006.01)

(52) U.S. Cl. ..... 381/423; 381/431

(58) Field of Classification Search ..... 381/152, 381/419, 423, 431, 396, 190; 181/148, 150, 181/157, 173
See application file for complete search history.

(56) References Cited

U.S. PATENT DOCUMENTS

| | | | | |
|---|---|---|---|---|
| 3,247,925 A | | 4/1966 | Warnaka | |
| 3,651,283 A | * | 3/1972 | Doschek | 381/419 |
| 6,522,760 B2 | * | 2/2003 | Azima et al. | 381/423 |
| 2002/0018578 A1 | * | 2/2002 | Burton | 381/431 |
| 2002/0027999 A1 | | 3/2002 | Azima | |

FOREIGN PATENT DOCUMENTS

| | | | |
|---|---|---|---|
| DE | 465 189 | | 8/1928 |
| DE | 484 409 | | 10/1929 |
| DE | 484 872 | | 10/1929 |
| DE | 195 41 197 | | 7/1997 |
| DE | 199 55 867 | | 6/2001 |
| DE | 199 60 082 | | 7/2001 |
| JP | 61-94499 | * | 5/1986 |
| JP | 6194499 | | 5/1986 |
| JP | 220785-1999 | | 8/1999 |
| JP | 2001-238285 | | 8/2001 |

OTHER PUBLICATIONS

PCT International Search Report (Regal 41.1 PCT); Feb. 24, 2004.
PCT IPEA (Regal 71.1 PCT); Sep. 17, 2004.

* cited by examiner

*Primary Examiner*—Brian Ensey
(74) *Attorney, Agent, or Firm*—Beyer Law Group LLP

(57) ABSTRACT

An inventive loudspeaker includes a diaphragm, a first excitation means for generating structure-borne sound in the diaphragm, and a second excitation means, different from the first one, for setting the diaphragm into a longitudinal vibrational motion in a direction perpendicular to the extension of the diaphragm. In accordance with the invention, the problem of insufficient bass reproduction and/or of the magnitude conflicting with invisible integration or installation is solved in that a second exciter system is introduced, which uniformly moves the diaphragm, or the plate serving as the diaphragm, forward and backward in addition to the bending waves of the structure-borne sound. The sound reproduction therefore is possible across the entire audio-frequency range without impeding the goal of invisible integration or installation.

23 Claims, 4 Drawing Sheets

FIGUR 1A
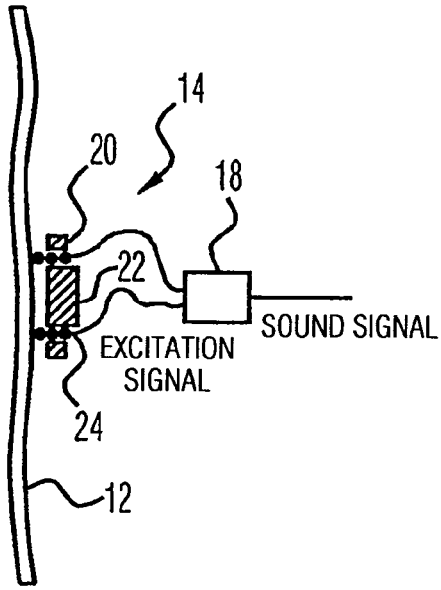
FIGUR 1B
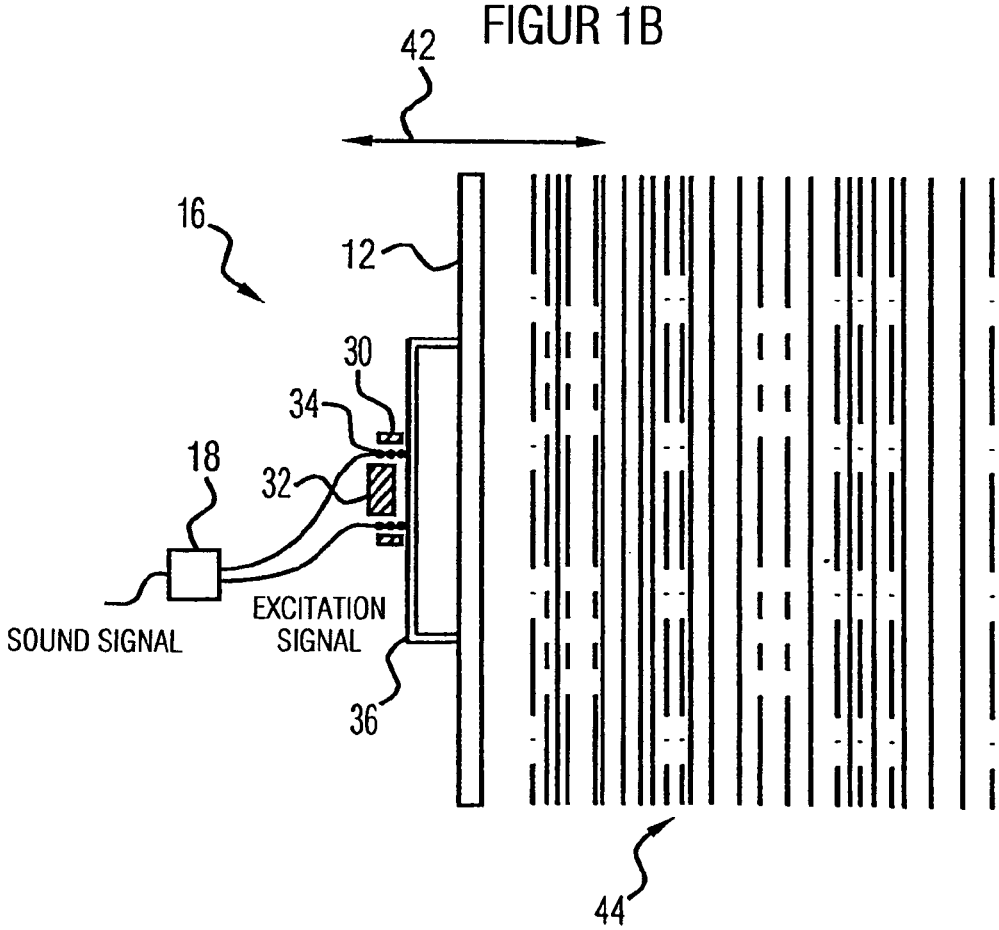

FIGUR 1C
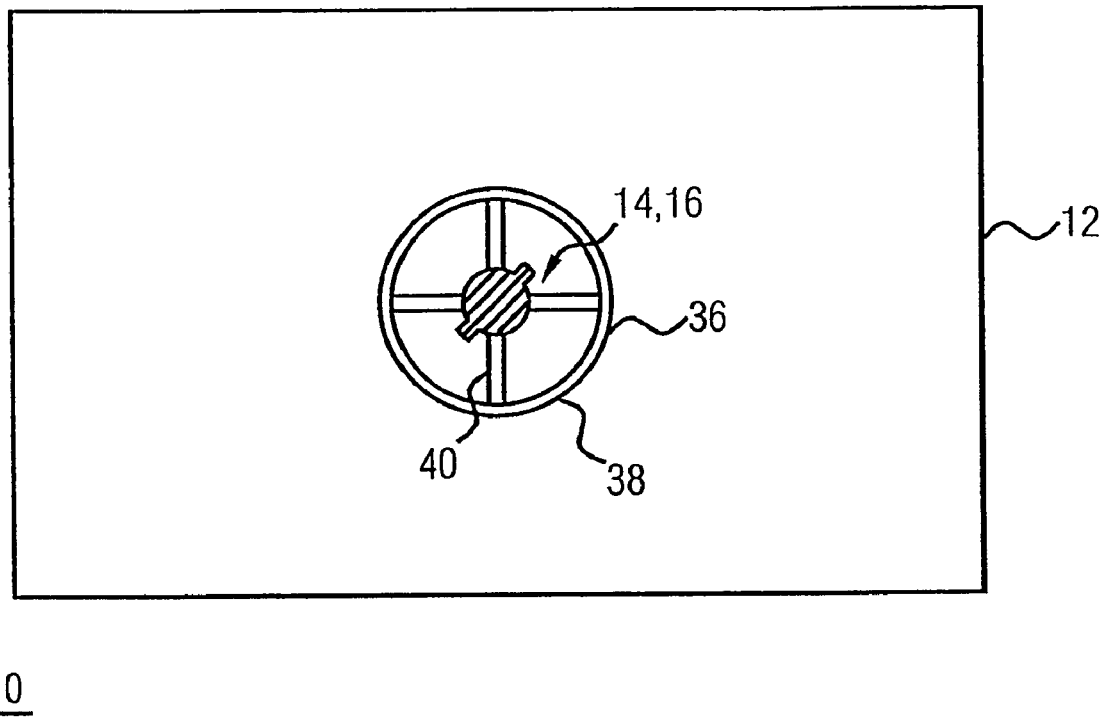
FIGUR 1D
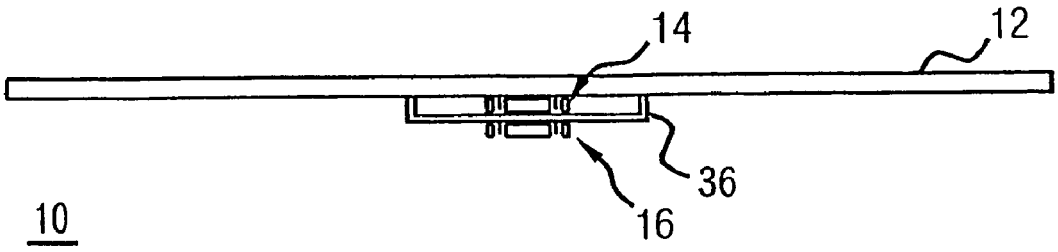

FIGUR 2A
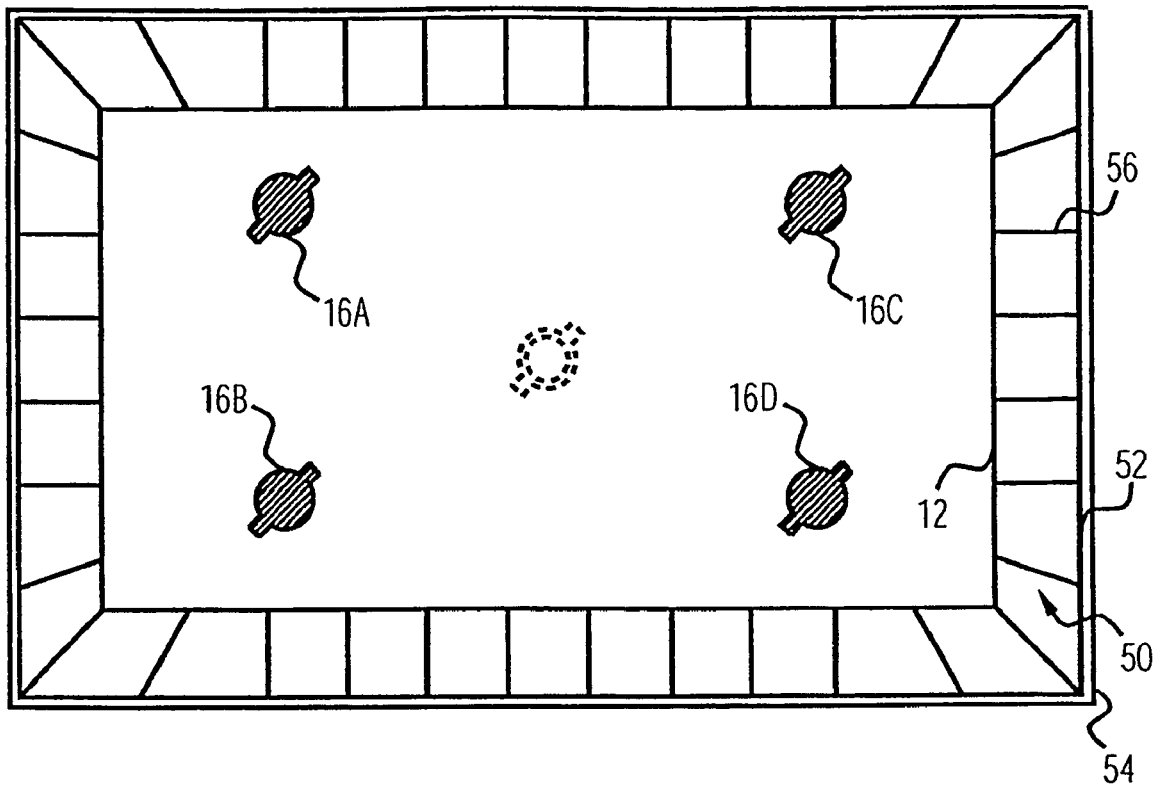
FIGUR 2B
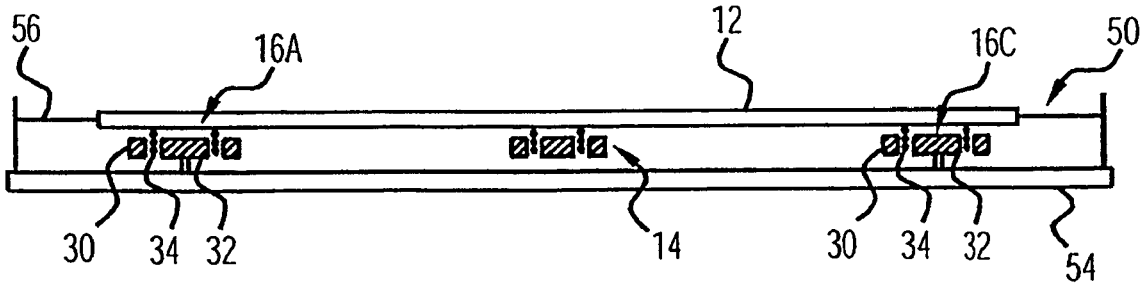
FIGUR 3
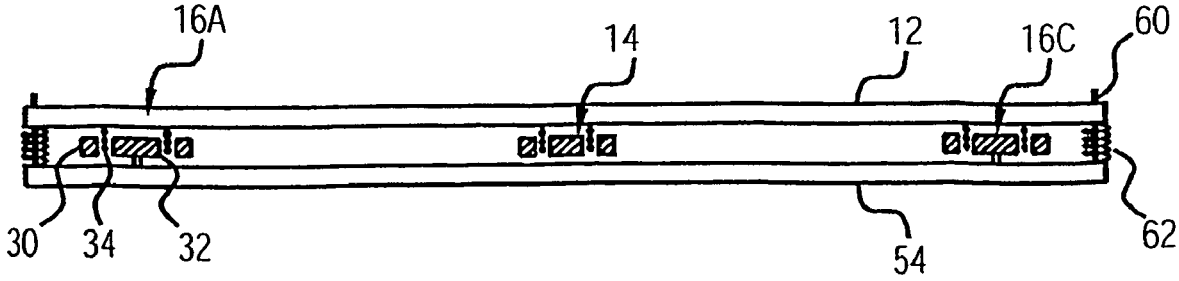

FIGUR 4
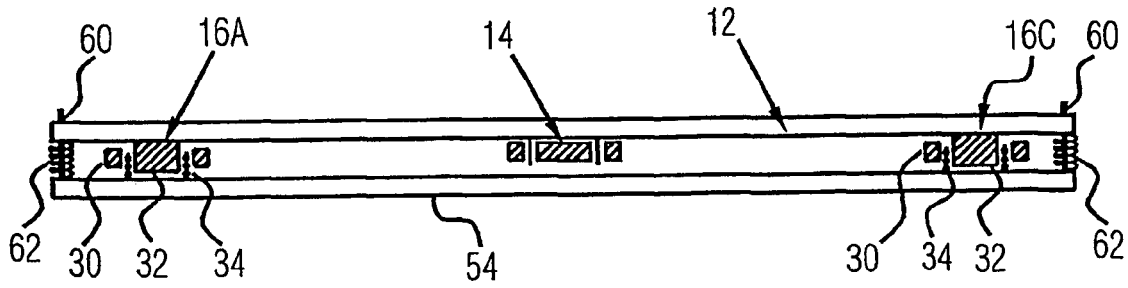
FIGUR 5
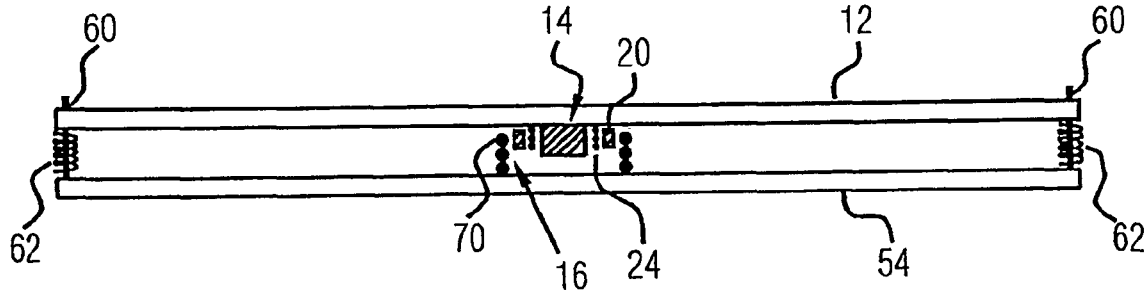
FIGUR 6
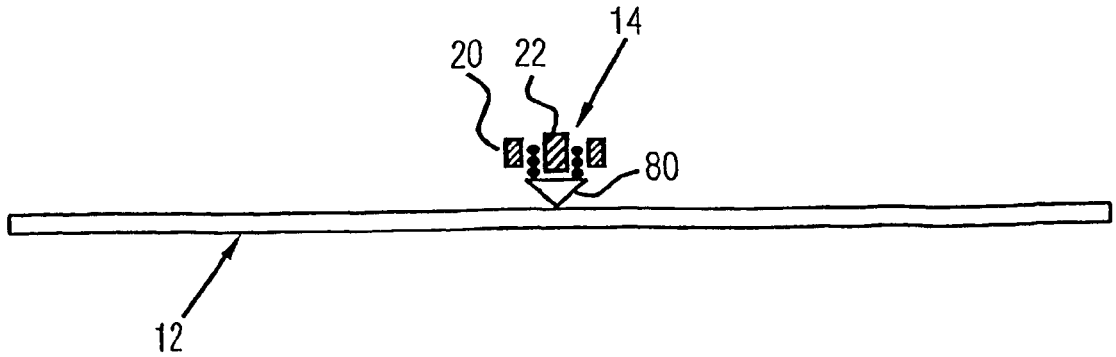

LOUDSPEAKER

CROSS-REFERENCE TO RELATED APPLICATION

This application is a continuation of copending International Application No. PCT/EP03/09036, filed Aug. 14, 2003, which designated the United States and Japan, and was not published in English and is incorporated herein by reference in its entirety.

BACKGROUND OF THE INVENTION

1. Field of the Invention

The present invention relates to loudspeakers, and in particular to flat-panel loudspeakers or flat-panel sound transducers.

2. Description of Prior Art

The tendency which is evident in home entertainment products towards ever smaller and ever more compact components also applies to loudspeaker technology. The trend even goes as far as suggesting that loudspeakers should not only be small, but also "invisible" to the listener, i.e. hidden from the listener's eyes. The possibility of invisible installation is very useful particularly for multi-channel playback, such as surround, and for wave-field synthesis (WFS). The number of individual channels and thus loudspeakers required herefore rapidly amounts to more than 50 items. However, since such playback systems are also to be developed and offered for home use, and since it must be assumed that the customer, for space reasons, does not wish to fit 50 conventional loudspeakers into his/her living room for, e.g., a WFS system, alternative loudspeakers will have to be employed.

The aim is to design loudspeakers such that they may be integrated with other pieces of equipment or furniture, so that in this manner, they may be distributed across the rooms in an inconspicuous manner. For example, there have already been loudspeakers that act as picture frames, as monitors or even as doors of wardrobes at the same time.

Cone loudspeakers are not suitable for technical implementation of these "hidden" loudspeakers, since cone loudspeakers are not flat enough due to their diaphragm shape. A loudspeaker whose diaphragm is flat as a plate to start with and whose electroacoustic excitation system is as small as possible in terms of dimensions is more suitable. This principle, i.e. the use of a plate as a diaphragm in connection with the use of an excitation system, has already been employed in DE 465189, published in 1929, and its supplements DE 484409 and 484872 for acoustic shop-window advertising. Then, a window pane of a shop window served as a diaphragm which was excited by means of an attached electrodynamic excitation system so as to reproduce sound.

The functional mechanism underlying this principle is that an electrical signal applied to the electrodynamic excitation system is transformed to a mechanical audio-frequency vibration. At an excitation point, where the excitation system is present at or fixed to the diaphragm, this mechanical vibration is transferred to the plate serving as the diaphragm, whereby structure-borne sound is produced in the plate. It is in particular that portion of structure-borne sound which propagates in the diaphragm by means of bending waves that provides for the generation of air-borne sound.

With this loudspeaker principle, the generation of air-borne sound consequently is effected via the indirect way of structure-borne sound. Unlike with cone loudspeakers, the longitudinal mechanical vibrational motions of the vibrational pulses of the excitation system are not taken over by the diaphragm and immediately translated into air-borne sound, but structure-borne sound is initially created in the diaphragm, which—in particular, the ending-wave portion of same—subsequently excites the surrounding air to form longitudinal waves, or compressional waves, i.e. sound. The transformation of structure-borne sound to air-borne sound here acts like a filter in the chain of signals. As a result, only that portion of the signal to be reproduced which may propagate as structure-borne sound in the plate and may subsequently be radiated off into space is reproduced as air-borne sound.

Since, as has already been mentioned, that portion of structure-borne sound that propagates in the form of the bending wave makes the largest contribution to generating air-borne sound by means of a plate diaphragm, the properties of the bending wave, in particular its excitation and propagation, have a decisive impact on the design of a flat-panel loudspeaker in accordance with the bending-wave principle. If these properties are taken into consideration, this results in the fact that for broad-band sound reproduction, low-weight and large-size diaphragm plates are required. The plate size required, however, conflicts with the aim of invisible integration of the loudspeaker into the surroundings of the listener. As an example, the reproduction of the frequency range below about 200 Hz is of poor quality with relatively large plates. The reason for this is that a plate resonates only in its eigenmodes with its associated natural frequencies, and that the mode densities, i.e. the number of modes per frequency range, is decisive for sound reproduction. However, sufficient mode density has not been achieved so far below 200 Hz.

Thus, there is a need for a loudspeaker which is amenable, on the one hand, to invisible integration, i.e. which may be implemented to be flat and small, and which, on the other hand, enables satisfactory sound reproduction not only in the medium- and high-tone ranges, but also in the low-tone, or bass, range.

DE 19541197 A1 describes a cone loudspeaker having an electrodynamic vibration system, a cone-shaped diaphragm, a surround and a basket where the diaphragm is suspended above the surround. When a sound signal is applied to the vibration system, the diaphragm performs an upward movement along the center line. The diaphragm is provided with a layer of a piezoelectrical material which is also connected to the sound-signal source and experiences changes of extension in the process. Depending on whether the layer is connected to a further layer or is a bimorphous arrangement of two longitudinally and/or radially vibrating plates which are oppositely poled and glued to one another, the layer acts as a thickness vibrator or as a bending vibrator.

DE 19960082 A1 describes a loudspeaker having a plate diaphragm driven by a vibration drive at its back. During the vibration the plate diaphragm performs an upward movement.

SUMMARY OF THE INVENTION

It is the object of the present invention to provide a loudspeaker which, at a fixed size, enables improved reproduction quality, or which enables, at a fixed reproduction quality, a more compact structure.

The invention provides a loudspeaker having a diaphragm; a first exciter for generating structure-borne sound in the diaphragm; and a second exciter, different from the first one, for setting the diaphragm into a longitudinal vibrational motion in a direction perpendicular to the extension of the diaphragm, the second exciter having an electrodynamic drive which comprises a first part including an oscillator coil and a second part including a magnet, one of the first and second parts being attached in a stationary manner, whereas the other part is attached to the diaphragm or contacts same.

An inventive loudspeaker includes a diaphragm, a first excitation means for exciting structure-borne sound in the diaphragm, and a second excitation means different from the first one for setting the diaphragm into a longitudinal vibrational motion in a direction perpendicular to the diaphragm extension.

In accordance with the invention, the problem that this insufficient low-tone reproduction, on the one hand, and the size which conflicts with invisible integration, or installation, on the other hand, is solved by introducing a second excitation system which uniformly moves the diaphragm, or the plate serving as the diaphragm, forwards and backwards in addition to the bending vibrations of the structure-borne sound. Thereby, sound reproduction is possible across the entire audio-frequency range without impeding the aim of invisible integration, or installation.

In other words, the core concept of the present invention is that broad-band reproduction may be achieved by means of a compact loudspeaker consisting of a diaphragm and an associated excitation means by using two different excitation means for exciting the diaphragm, which set the diaphragm into vibration in different manners, and are responsible for different frequency bands, or frequency ranges. One prior-art excitation means for generating structure-borne sound in the diaphragm is only responsible, according to the invention, for reproducing the high- and medium-tone range, and its task is only to excite as many bending waves in the diaphragm as possible. The low-tone range, which has been missing so far, is taken over by the excitation means added in accordance with the invention which excites the diaphragm to perform longitudinal forward and backward vibrating movements with a large stroke. In opposition to the sound generation performed by the structure-borne sound excitation means, the diaphragm is excited to perform longitudinal vibrations by the second excitation means introduced in accordance with the invention, whereby the diaphragm thus vibrates within itself in the form of bending waves and additionally moves forwards and backwards as a whole in a uniform manner.

The deflection of the second excitation means may be far larger than that of the bending waves of the structure-borne sound generation means. Since the diaphragm has a relatively large fictitious diaphragm surface, a large volume of air is moved by the uniform forward and backward motion of the plate. In this manner, the generation of a sufficient sound level in the bass area is clearly easier to implement than with the bending-wave principle, wherein the diaphragm deflections may also be smaller.

An advantage of the present invention, in turn, is that combining both excitation types, i.e. the generation of structure-borne sound and longitudinal vibrational forward and backward motion, on a diaphragm, enables a clearly better reproduction of the entire audio frequency range.

Since the excitation means, added in accordance with the invention, for setting the diaphragm into a vibrational forward and backward motion enables a larger diaphragm stroke in the bass range, the diaphragm surface may be reduced, while maintaining the reproduction quality. In contrast thereto, flat-panel speakers based only on production of structure-borne sound, require a very large diaphragm surface area to generate sufficient sound level in the bass area, since the small diaphragm stroke of the bending waves must be offset by as large a diaphragm surface area as possible so as to achieve the same volume displacement, which is why conventional flat-panel loudspeakers need to be relatively large. Consequently, an advantage of the present invention is also that due to its compactness, an inventive loudspeaker is more suitable for invisible integration or installation.

Conversely, an advantage of the present invention is that due to the combination of the two excitation means, the bass reproduction is clearly improved while the diaphragm size remains the same. The advantage of invisible integration or installation is not cancelled by this, but is supplemented by improved reproduction quality.

A further advantage of the present invention is that due to the fact that the longitudinal vibrational motion moves a large volume of air, the bass-reflex principle may be effectively employed, which has not led to any improvement in bass-range reproduction with previous flat-panel loudspeakers.

A further advantage of the present invention is that—since reproduction in the bass range is taken over by the generation of vibrational forward and backward motions of the diaphragm—the structure-borne sound generation means may also function in accordance with the piezoelectrical principle, which so far has only been possible, at the expense of bandwidth, when using only structure-borne sound generation due to the very narrow frequency range for which the piezoelectrical principle is suited. By the combination with the additional excitation system for a longitudinal vibrational motion of the diaphragm, a marked improvement in sound reproduction is achieved as a result, so that the structure-born sound generation means may function in accordance with the piezoelectrical principle.

BRIEF DESCRIPTION OF THE DRAWINGS

Further preferred embodiments of the present invention will be explained below in more detail with reference to the accompanying figures, wherein:

FIG. 1*a* shows a diagrammatic partial-section side view of a flat-panel loudspeaker in accordance with an embodiment of the present invention, wherein only the plate serving as a diaphragm is shown along with the structure-borne sound generation means without the longitudinal vibration excitation means, the vibration behavior of the diaphragm, i.e. the bending waves generated by the structure-borne sound generation means, being indicated;

FIG. 1*b* is a diagrammatic partial-section side view of the loudspeaker of FIG. 1*a*, wherein only the plate serving as the diaphragm and the longitudinal vibration excitation means are shown rather than the structure-borne sound generation means, the vibration behavior, i.e. the forward and backward vibrational motion, of the plate due to the longitudinal vibration excitation means being indicated as well;

FIG. 1*c* is a diagrammatic front view of the loudspeaker of FIGS. 1*a* and 1*b;*

FIG. 1*d* is a diagrammatic partial-section plan view of a loudspeaker wherein the longitudinal vibration excitation means of FIG. 1*b* and the structure-borne sound generation means of FIG. 1*a* are combined into a loudspeaker;

FIGS. 2*a* and 2*b* depict diagrammatic front and partial-section plan views of a loudspeaker in accordance with a further embodiment of the present invention;

FIG. 3 is a diagrammatic partial-section plan view of a loudspeaker in accordance with a further embodiment of the present invention;

FIG. 4 is a diagrammatic partial-section plan view of a loudspeaker in accordance with a further embodiment of the present invention;

FIG. 5 is a diagrammatic partial-section plan view in accordance with a further embodiment of the present invention; and FIG. 6 is a partial-section plan view of a loudspeaker in accordance with a further embodiment of the present invention, wherein only the structure-borne sound generation means is shown rather than the longitudinal vibration excitation means.

DESCRIPTION OF PREFERRED EMBODIMENTS

Before the present invention will be explained in more detail below with reference to the figures, it shall be pointed out that elements which are identical or identical in their functions are designated by the same or similar reference numerals in the drawings, and that a renewed explanation of these elements is omitted in order to avoid repetitions in the specification.

With regard to FIGS. 1*a* to 1*d*, the general principle of the present invention will initially be explained in more detail for a loudspeaker using an embodiment. The loudspeaker, generally indicated by 10, essentially consists of a plate 12 serving as a diaphragm, a structure-borne sound generation means 14, a longitudinal vibration excitation means 16, and an excitation signal generation means 18.

The structure-borne sound generation means 14 operates in accordance with the electrodynamic principle and is shown in more detail, in cross section, in FIG. 1*a*. The structure-borne sound generation means 14 includes an annular permanent magnet 20 polarized along its rotation axis, a cylindrical pole body 22 which is arranged in a centered or coaxial manner with regard the annular permanent magnet 20, and an oscillator coil 24 extending in an annular gap of air between the pole body 22 and the permanent magnet 20. In addition, the structure-borne sound generation means 14 which is formed as an electrodynamic drive may exhibit, for example, plate- or ring-shaped pole plates. Evidently, a different structure of the electromotive drive is also possible. That part of the structure-borne sound generation means 14 which consists of the oscillator coil 24, on the one hand, and that part of the structure-borne sound generation means 14 which consists of the pole body 22 and the permanent magnet 20, on the other hand, are slidable with respect to one another. The structure-borne sound generation means 14 thus formed is fixed in a centered manner at the plate 12 via the part containing the vibrating coil 22. As will be described below, the reverse case is also feasible. Apart from that, the structure-borne sound generation means is not fixed, or is non-attached, i.e. the other part which consists of components 20 and 22 is freely moveable.

In the present document, diaphragm 12 has been described, in an exemplary manner, as an upright diaphragm 12 which has a coil 24 attached to it which is immersed into an annular gap of their between a cylindrical pole body 22 and an annular permanent magnet 20, pole body 22 and permanent magnet 20 forming a unit which is guided across oscillator coil 24 so as to be slidable, relative to same, in the direction perpendicular to the direction of extension of diaphragm 12. The upright diaphragm is, for example, part of a wall. In this perpendicular alignment, no force which points in the direction of the normal to surface of diaphragm 12, i.e. points in that direction in which this part may be shifted relative to the oscillator coil 24, but only the force of gravity pointing downwards is exerted onto the non-attached parts 20, 22 of drive 14. Without the excitation signal being applied, there is consequently no reason for parts 20, 22 to be dispensed with. In addition, this part naturally exhibits a certain amount of inertia, so that the excitation means 14, which, as is known, is provided for generating structure-borne sound in the diaphragm 12, i.e. mechanical waves in the grid of diaphragm 12 which propagate within same, is excited at high frequency, and so that, at a sufficient amount of inertia and/or sufficient weight of the free movable parts 20, 22 of the drive compared with the inertia and/or the weight of diaphragm 12, this part will substantially not leave its position but will rather move the oscillator coil 24 forwards and backwards along with the diaphragm 12 within the gap of air, and will continue to prevent the freely movable part 20, 22 from being pulled down by gravity. Factors such as the elasticity of the diaphragm material play a part in how much the diaphragm 12 and, therefore, the oscillator coil 24, is deflected, so that the oscillator coil 24 can be prevented, with appropriate care being taken, from sliding out of the gap of air of the excitation means 14. In addition, the stroke caused by the longitudinal vibration excitation means 16 must also be taken into account to prevent the coil from being pulled out of the gap, which stops, as it were, due to the inertia of the free moveable part. This may be effected, for example, by a corresponding length of overlap of coil 24 and the air gap. In addition, an elastic connection may be provided between the two parts of drive 14 which are slidably displaceable against one another, so that the freely moving part is moved, when vibrations are present, along with the diaphragm and the part fixed to same, and additionally produces structure-borne sound in the diaphragm due to higher-frequency motions relative to the fixed part.

Evidently, a loudspeaker of the type shown may also be fixed in a different position, e.g. at the ceiling. In this case, however, additional provisions would have to be made for the moveable parts of drive 14 to be coupled to one another, such as via an elastic connection in addition to the mechanical air-gap oscillator-coil guide, so that the two moveable parts of drive 14 by themselves form a vibrating system, and so that the freely moveable part of drive 14 is prevented from sliding down and out of the guide by coil 24.

In accordance with the electrodynamic principle, the electrodynamic drive 14 transforms an electrical excitation signal flowing through oscillator coil 24 to a mechanical relative vibrational motion between the two parts, i.e. the part fixed to plate 12 and the freely movable part. The freely moveable part advantageously exhibits sufficient inertia to effectively transmit the mechanical relative vibrational motion to plate 12, whereby structure-borne sound and, in particular, bending waves are produced in plate 12, as is shown in an exaggerated form in FIG. 1*a*. The oscillator coil 24 receives the excitation signal flowing through oscillator coil 24 from the excitation signal generation means 18, which, in turn, generates same from an electrical sound signal which suitably indicates the information to be rendered.

The longitudinal vibration excitation means 16, too, functions in accordance with the electrodynamic principle and is depicted in cross section in FIG. 1*b*. The longitudinal vibration excitation means 16 is arranged coaxially in relation to structure-borne sound generation means 14. The electrodynamic drive of longitudinal vibration excitation means 16 also includes a permanent magnet 30, a pole body 32 and an oscillator coil 34. Oscillator coil 34 also obtains its electrical excitation signal from excitation signal generation means 18, which generates said electrical excitation signal from the same sound signal indicating the information to be rendered. The part including the oscillator coil 34 contacts plate 12—or is connected to it—via an adapter 36. In other words, oscillator coil 34 is fixedly connected to adapter 36, which extends from oscillator coil 34 in the direction of plate 12 and expands radially in the process so as to come to lie, in the idle state of loudspeaker 10, on plate 12 along an annular excitation area of a certain diameter, or to be fixed, such as glued, to plate 12 so as to surround structure-borne sound generation means 14 together with plate 12. In particular, adapter 36 consists of a cylinder barrel 38 of a diameter exceeding one tenth of the extension of plate 12 at the narrowest point, and of ridges 40 extending radially and connecting cylinder barrel 38 with oscillator coil 34, such that cylinder barrel 38 is aligned coaxially to an excitation point, at which the mechanical vibration of structure-borne sound generation means 14 is exerted onto plate 12.

Adapter 36 does not have to exhibit, as is shown in FIGS. 1*a* to 1*d*, an annular cross section, or an circular excitation area and be formed as a ring adapter, but may also be rectangular, for example. The extension of the excitation area amounts to, e.g., between one tenth and nine tenths of the extension of plate 12 in the respective extension direction of plate 12. Adapter 36 enables the mechanical vibration of drive 16 to lead to a longitudinal vibrational motion of plate 12 in an almost overall, i.e. translatory, manner, as will be explained below. Due to the coaxial or central symmetric structure, the influence exerted by the longitudinal vibration excitation means 16, by means of the excitation area, or bearing surface area, on the bending waves generated by structure-borne sound generation means 14, the bending waves propagating from the coaxial excitation point of structure-borne sound generation means 14 in a nearly isotropic manner, is reduced.

Supports may be arranged along the bearing surface of adapter 36 which project from adapter 36 in the direction of plate 12, so that adapter 36 bears on plate 12, or is attached to same, only at isolated points of support, i.e. the ends of the supports. Hereby, the influence of adapter 36 and/or of longitudinal vibration excitation means 16 on the structure-borne sound produced may be further reduced without significantly compromising the uniformity of the drive of longitudinal vibration excitation means 16.

While that part of the electrodynamic drive of longitudinal vibration excitation means 16 which consists of oscillator coil 34 is connected to plate 12 via adapter 36 or is coupled to plate 12 by bearing on same, the other part consisting of magnet 30 and pole body 32 is fixed in a stationary manner, such as attached to a backpanel of the loudspeaker (not shown). In this manner, the transmission of force of the mechanical vibration produced by longitudinal vibration excitation means 16 to plate 12 is more pronounced than with structure-borne sound generation means 14.

Since the structure of the loudspeaker of FIGS. 1*a* to 1*d* has been described above, its mode of operation will be described below. In order to transform the electrical sound signal indicating the information to be rendered to air-borne sound in the form of longitudinal waves and/or compressional waves, loudspeaker 10 includes both means 14 and 16. Both means 14 and 16 are responsible for rendering the information to be rendered for different frequency ranges, or frequency bands. Structure-borne sound generation means 14 is responsible for reproducing the high- and medium-frequency ranges, whereas longitudinal vibration excitation means 16 is responsible for the bass range. Even though it is possible to feed the electrical sound signal to the electrodynamic drives of both means 14 and 16 and thus to feed both of them with the same excitation signal, which would render means 18 superfluous, as the case may be, it is preferred that they are fed with different excitation signals deviating from one another with regard to the frequency band and being adapted in an optimum manner to the respective area of operation of means 14 and 16, respectively. Thus/for example, means 14 obtains a higher-frequency portion of the sound signal than means 16. The frequency range of the excitation signal for structure-borne sound generation means 14 spans, e.g., 100 Hz to 25 kHz, and preferably 150 Hz to 20 kHz, whereas the frequency range of the excitation signal for longitudinal vibration excitation means 16 spans, e.g., 10 Hz to 2 kHz and, preferably, 20 Hz to 200 Hz. For this purpose, excitation signal generation means 18 may be implemented, e.g., as a frequency-separating means. Thus, it is generally advantageous for the frequency range to include, for generating structure-borne sound, a frequency which higher than all frequencies included in the frequency range for longitudinal vibration excitation, or the frequency ranges include a first frequency at which the excitation signal for generating structure-borne sound is higher than the other excitation signal, and a second frequency, which is lower than the first frequency, at which the excitation signal for longitudinal vibration excitation is the same as the other excitation signal or is higher than same.

The mechanical vibrational motions produced by the excitation signal flowing through oscillator coil 24 cause structure-borne sound and, in particular, bending waves in plate 12 which are, in turn, transformed to air-borne sound at the air/plate interface. To this end, structure-borne sound generation means 14 preferably exhibits a sufficient moment of inertia.

Longitudinal vibration excitation means 16 sets plate 12 into longitudinal vibrational motions 42 with a stroke which is significantly larger, e.g. more than 20 times larger can be, than the amplitude of structure-borne sound generation means 14, such as 20 mm. This longitudinal forward and backward motion 42 performed by plate 12 immediately leads to longitudinal air-borne sound waves, or compressional waves 44, in the bass range. So as to enable the large stroke of longitudinal vibration excitation means 16 without causing the oscillator coil 34 to no longer be able to be immersed into the field of the air gap in a perpendicular manner, and thus without causing distortions to be formed, because of the mass of the drive of longitudinal vibration excitation means 16, longitudinal vibration excitation means 16 is fixed with that part of the drive which includes magnet 30 and pole body 32, such as at a back-panel. Adapter 36 serves to transmit the mechanical vibrational motion of oscillator coil 34 in a manner distributed across plate 12 such that plate 12 is excited to perform essentially translatory vibrational motions in the direction perpendicular to an extension direction of plate 12, i.e. such that the plate vibrates back and forth as a whole as much as possible. Thus, plate 12 vibrates in the form of bending waves, as is shown in FIG. 1*a*, and additionally vibrates forward and backward as a whole in a uniform manner as is shown by the double arrow 42 in FIG. 1*b*.

Even though it would be possible to support plate 12 only via a fixed connection via adapter 36 with that part of the drive of longitudinal vibration excitation means 16 which includes oscillator coil 34, and to support the guide of this part in that part which includes permanent magnet 30 and pole body 32, such as when mounting the loudspeaker at the ceiling such that it is suspended from same, it is preferred to additionally provide a bracket for plate 12, as is the case in the following embodiments. Even though it is also possible to generate the translatory longitudinal vibrational motion 42 of plate 12 by means of the electrodynamic drive only, it is preferred for plate 12 to be suspended or journalled in an oscillatory manner such that, when plate 12 undergoes a longitudinal translation from an idle position of same in the direction perpendicular to the extension of the plate, a force caused by the suspension counteracts this translatory deflection to return the diaphragm to the idle position. In this manner, suspension and plate 12 form a vibrating system wherein plate 12 is capable of moving back and forth in a translatory manner in a direction perpendicular to the direction of extension. This vibrating system should be designed for a natural frequency near the bass range for which longitudinal vibration excitation means 16 is responsible, so as to be able to exploit the resonance step-up.

Several embodiments will be described below, by means of which various possibilities of suspending the plate serving as a diaphragm, of attaching the longitudinal vibration excitation means as well as of positioning same on the plate will be described.

FIGS. 2*a* and 2*b* show an embodiment of a loudspeaker, wherein the only differences compared with the embodiment of FIGS. 1*a* to 1*d* are that the longitudinal vibration excitation means consists of four drives 16*a*, 16*b*, 16*c* and 16*d* which operate in an electrodynamic manner, and that plate 12 serving as the diaphragm is suspended from a frame 52 by means of a spider 50, which frame 52, in turn, is attached to a backpanel 54, to which, in turn, that part of the drives 16*a*-

16*d*, operating in an electrodynamic manner, which includes permanent magnet 30 and core 32 is attached.

The spider 50 consists of elastic bands 56, such as rubber bands, which are mounted along the circumference and which extend, in a manner in which they show the way to follow, from their mounting ends at the circumference of plate 12 in an essentially star-like manner from the center of plate 12 outwards so as to be attached at frame 52 at the other end. With regard to their attachment and spring constants, bands 56 are designed such that each part of the edge is influenced in the same manner. The fact that drives 16*a*-16*d* are attached to the backpanel, on the one hand, and that plate 12 is suspended by means of spider 50, on the other hand, does away with the risk that due to the mass of drives 16*a*-16*d*, the oscillator coils 34 of same are no longer able to be immersed perpendicularly into the field of the air gap, and that this may cause distortions. During assembly, plate 12 serving as a diaphragm, and drives 16*a* to 16*d* are preferably adjusted such that none influences the direction of motion of the other. In this manner, the mass of the diaphragm, or plate, and the mass of longitudinal vibration excitation means 16 have no influence on the direction of vibration of the excitation coils 34 of drives 16*a*-16*d*. Spider 50 takes on the function of a surround which attenuates diaphragm, or plate, 12 after each deflection and takes it back to the starting position, or idle position. Backpanel 54 may serve as part of a loudspeaker housing. However, the provision of a loudspeaker housing is not necessary. Since drives 16*a*-16*d* are arranged in a centrally symmetric manner, the disturbance caused by them due to their contact, or connection, with plate 12 at the excitation points with regard to the bending waves generated by structure-borne sound generation means 14 are reduced. The excitation drives (16*a*-16*d*) are driven, in an in-phase manner, either by one and the same excitation signal or by such excitation signals which differ with regard to the amplitudes, so as to offset the fringe effects of diaphragm plate 12.

With reference to FIG. 3, a description will be given of an embodiment of a loudspeaker which differs from the loudspeaker of FIGS. 2*a*-2*b* by a different suspension, which, however, also enables plate 12, serving as the diaphragm, to perform a translatory longitudinal vibrational backward and forward motion in about an idle position. In this embodiment, the diaphragm 12 is spring-mounted on one axle 60, respectively, per corner of rectangular plate 12 serving as the diaphragm. Axles 60 are firmly attached to backpanel 54, which also has drives 16*a*-16*d* mounted to it, axles 60 protruding perpendicularly from backpanel 54 which extends parallel to plate 12, i.e. axles 60 extending in the direction of the translatory longitudinal vibrational motion caused by drives 16*a*-16*d*. Mounting plate 12 at each corner is implemented, for example, by a respective hole at each corner, through which the respective axle 60 extends. Spring-mounting plate 12 at each corner on axles 60 is achieved, for example, by coil springs 62 which surround axles 60, are guided by them and have ends attached to the respective corner of plate 12, and have fixed ends connected, e.g., to backpanel 54. Evidently, any other elastic means may be employed to define a minimum of potential for the respective corner.

Perpendicular immersion of the spring coils of drives 16*a*-16*d* is also ensured by the suspension of FIG. 3. In addition, the assembly preferably is implemented, again, such that diaphragm 12 and drives 16*a*-16*d* do not mutually influence their directions of motion. As is also the case in FIGS. 2*a* and 2*b*, backpanel 54 may serve as part of a loudspeaker housing. The mass of the diaphragm and the mass of longitudinal vibration excitation means 16 exert less influence on the direction of vibration of oscillator coils 34 of drives 16*a*-16*d*, i.e. they are immersed into the respective air gap just like in the non-assembled state. The coils take on the function of the surround which attenuates diaphragm 12 after each deflection and returns it to the starting position.

As has already been described with reference to FIGS. 1*a*-1*d*, that part of the drives of the longitudinal vibration excitation means which includes the oscillator coil may either be firmly connected to plate 12 or may only bear on same. In both cases it is preferred that during the assembly of the loudspeakers of FIGS. 2*a*, 2*b* and 3, the distance between diaphragm plate 12 and drives 16*a*-16*d* in the idle position of diaphragm plate 12 is set such that they just about have contact, but do not exert any forces upon one another in the idle position. In order to make it easier for the diaphragm plate to follow the motions of drives 16*a*-16*d*, that part of same which includes oscillator coil 22, or 34, is preferably glued, for example, with plate 12.

FIG. 4 shows an embodiment of a loudspeaker wherein, unlike the loudspeaker of FIG. 3, the drives 16*a*-16*d*, which constitute the longitudinal excitation means, are not attached to the diaphragm plate 12 via the part including the oscillator coil 34, such as via an oscillator-coil support, but via that part of the electrodynamic excitation system which includes permanent magnet 30. Oscillator coil 34, however, is attached to loudspeaker backpanel 54 rather than to diaphragm plate 12. The perpendicular immersion of oscillator coil 34 into the gap of air between permanent magnet 30 and pole body 32 continuous to be provided by the suspension, i.e. axles .60 with springs 62, and/or spider 50.

FIG. 5 shows an embodiment of a loudspeaker, wherein, like in the previous embodiments, both excitation means 14 and 16 operate in accordance with the electrodynamic principle, the electrodynamic drive of longitudinal vibration excitation means 16 using the permanent magnet of structure-borne sound generation means 14 as the magnet. With regard to suspension and structure-borne sound generation means 14, the embodiment of FIG. 5 corresponds to that of FIGS. 3 and 4. Unlike the embodiments of FIGS. 3 and 4, longitudinal vibration excitation means, however, only includes an oscillator coil 70 which is arranged coaxially with oscillator coil 24 of the drive of structure-borne sound generation means 14 and is attached to backpanel 54. Both oscillator coils 24 and 70 interact with the same permanent magnet 20. In this design, a further pole body may additionally be provided around oscillator coil 70. Thus, oscillator coil 70 forms a circle around structure-borne sound generation means 14. As is also the case in the embodiments of FIGS. 2*a*, 2*b* and 3, that part of the drive of longitudinal vibration excitation means 16 which includes oscillator coil 70 is fixed, whereas the other part is attached to diaphragm plate 12, i.e. in the present case, the other part being permanent magnet 20 of structure-borne sound generation means 14. By contrast, the drive of structure-borne sound generation means 14 is attached only to plate 12, i.e. with that part which includes oscillator coil 24.

FIG. 6 shows an embodiment of a specific form of attachment of structure-borne sound generation means 14 to plate 12 serving as the diaphragm. Instead of attaching the oscillator coil to diaphragm plate 12 via an annular oscillator-coil support in an excitation region, as has been done in the previous examples, the embodiment of FIG. 6 provides an oscillator-coil support 80 which supports oscillator coil 24 and exhibits, on that side facing diaphragm plate 12, a cone-shaped part, the peak of the cone being connected to diaphragm 12. Thereby, an optimum dot excitation of plate 12, serving as the diaphragm, to form bending waves, and a higher top cut-off frequency of the structure-borne sound generation means are achieved.

Finally it shall be pointed out that it is possible to produce an inventive loudspeaker with a housing, wherein the plate serving as the diaphragm is suspended at the housing by means of air-tight suspension so as to seal the housing in an air-tight manner. To enable this, a special surround may be used, such as a continuous elastic band stretching from the circumference of plate 12 to the circumference of a respective recess of the loudspeaker box. For very heavy diaphragm plates, or combinations of diaphragm plate and glued-on excitation systems, the surround may also be supported, in addition, by the spring-axle suspension of FIG. 3 or by the spider suspension of FIGS. 2*a* and 2*b*. Since sufficient air volume is moved by the longitudinal translatory motion of the entire diaphragm, the bass reflex principle may additionally be used here. For this purpose, a hole for the reflection channel is integrated into the housing, for example on the side.

Even though only one structure-borne sound generation means was provided in each of the above embodiments, it shall be pointed out that in addition, several such means may be employed. Here, distribution around the center of the diaphragm plate is preferred. However, both in the case of having only one structure-borne sound generation means as well as in the case of having several structure-borne sound generation means, a decentralized arrangement at a distance from the center is also possible. The arrangement should be selected such that the bending waves are excited in an optimum manner.

In addition, for setting the diaphragm plate into longitudinal backward and forward vibrational motions, provision may be made not only of one or four drives, but of any number desired. When using several such longitudinal oscillatory drives, they are advantageously arranged such that the diaphragm plate is driven in a manner which is uniform across the entire surface. With several drives, the adapter may be dispensed with, such as is also the case with the examples of FIGS. 2-4. If several such longitudinal oscillatory drives are to be arranged, they are preferably always arranged in a central symmetric manner relative to the diaphragm plate. The use of several longitudinal vibrational drives increases the potential sound level of the loudspeaker.

In addition, it shall be pointed out that the above variations of the embodiments of FIGS. 1*a* to 6 may be combined with one another in any manner desired, both with regard to suspension, positions of the drives as well as mounting the parts of the drive which are movable relative to one another.

With regard to the above description of FIGS. 2*a* to 5 it shall also be pointed out that instead of the elastic, or oscillatory, suspension of the diaphragm plate by means of the elastic means described above, i.e. elastic bands 56 and springs 62, provision may also be made for elastic suspension or attachment of the drives of the longitudinal vibration excitation means, whereas the diaphragm plate is only guided by axles 60 or is free.

In addition, provision may also be made for other drives than those described above, drives which are based on a transducer principle different from the electrodynamic principle. In particular, the drive used for the generation of structure-borne sound could also be implemented as operating in accordance with the piezoelectrical principle, such as a piezocrystal which is connected to the diaphragm on the one side and to a weight on the other side, and which is freely movable apart from that.

Finally it shall also be pointed out that it is also possible for the structure-borne sound generation means to not be firmly connected to the diaphragm, but to be held such that it is suspended from above at a specific height by a suitable device, but otherwise to be held in a freely moveable manner in the longitudinal direction of vibration of the vertically aligned diaphragm so as to bear upon the diaphragm in the idle position.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A loudspeaker comprising a diaphragm;

a back panel;

a first exciter for generating structure-borne sound in the diaphragm; and a second exciter, different from the first one, for setting the diaphragm into a longitudinal vibrational motion in a direction perpendicular to the extension of the diaphragm, the second exciter having an electrodynamic drive which comprises a first part including an oscillator coil and a second part including a magnet, one of the first and second parts being attached in a stationary manner to the back panel, whereas the other part is attached to the diaphragm or contacts same.

2. The loudspeaker as claimed in claim 1, wherein the first exciter is configured to operate in accordance with the electrodynamic or piezoelectrical principles.

3. The loudspeaker as claimed in claim 1, further comprising:

a generator for generating a first electrical excitation signal having a first frequency range, and a second electrical excitation signal having a second frequency range from an electrical signal indicating information to be rendered, the first frequency range including a frequency higher than all frequencies included in the second frequency range, or the first and second frequency ranges including a first frequency, where the first excitation signal is higher than the second excitation signal, and a second frequency lower than the first frequency, where the second excitation signal is equal to the first excitation signal or is higher than the first excitation signal.

4. The loudspeaker as claimed in claim 1, wherein the first exciter is solely attached to the diaphragm so that the first exciter is freely movable apart from the attachment to the diaphragm.

5. The loudspeaker as claimed in claim 1, wherein the electrodynamic drive of the second exciter is attached in a stationary manner at such a distance from the diaphragm that in an idle state, the second exciter and the diaphragm do not exert any forces upon each other.

6. The loudspeaker as claimed in claim 1, wherein the second exciter is attached to the diaphragm.

7. The loudspeaker as claimed in claim 1, wherein the second exciter is configured to excite the diaphragm in a contiguous, extended area along the diaphragm.

8. The loudspeaker as claimed in claim 1, wherein the second exciter is configured to excite the diaphragm at a plurality of excitation points along the diaphragm.

9. The loudspeaker as claimed in claim 1, wherein the second exciter is configured to excite the diaphragm in a uniform manner.

10. The loudspeaker as claimed in claim 7, wherein the contiguous, extended area or the plurality of excitation points are arranged in a central symmetric manner relative to the diaphragm.

11. The loudspeaker as claimed in claim 1, wherein the part connected or coupled to the diaphragm is attached to the diaphragm or contacts same via an adapter which, via supports spaced away from another, bears on the diaphragm, or is attached to the diaphragm.

12. The loudspeaker as claimed in claim 1, wherein the part including the oscillator coil is attached to the diaphragm or contacts same via an adapter such that a vibration of the oscillator coil is transferred to the diaphragm along an annular excitation area.

13. The loudspeaker as claimed in claim 1, wherein the second exciter has several exciter units driven by identical excitation signals.

14. The loudspeaker as claimed in claim 1, further comprising:

a suspension for mounting the diaphragm in an oscillatory manner, such that it enables a longitudinal translation of the diaphragm from an idle position of same in the direction perpendicular to the extension of the diaphragm, and wherein the translation of the diaphragm from the idle position is operative to counteract the translation.

15. The loudspeaker as claimed in claim 1, further comprising:

a spider by means of which the diaphragm is suspended.

16. The loudspeaker as claimed in claim 1, wherein the diaphragm is mounted, along the circumference, by axles extending perpendicularly to the extension of the diaphragm, so as to be movable in the direction perpendicular to the extension of the diaphragm, a spring being provided at each axle which is attached, with one end, to the circumference of the diaphragm, whereas the other end is attached in a stationary manner.

17. The loudspeaker as claimed in claim 1, wherein the first and second exciter are configured to operate in an electrodynamic manner, the first exciter having a first oscillator coil and a permanent magnet and being attached to the diaphragm, and the second exciter having a second oscillator coil which surrounds the first exciter to interact with the first permanent magnet.

18. The loudspeaker as claimed in claim 1, wherein the first exciter has a cone-shaped part and a further part which are moveable relative to each other in a direction perpendicular to a direction of extension of the diaphragm, wherein a cone peak of the cone-shaped part cone peak is attached to the diaphragm and defines an excitation point where a mechanical vibration of the first exciter is transferred to the diaphragm.

19. The loudspeaker as claimed in claim 1, wherein the diaphragm is suspended at the back panel such that it is moveable, in a translatory manner, in the direction perpendicular to the extension of the diaphragm, and where the second exciter is attached, and forms, along with the diaphragm, a bass reflex housing.

20. The loudspeaker as claimed in claim 19, wherein the back panel forms, along with the diaphragm, a bass reflex housing.

21. The loudspeaker as claimed in claim 1, wherein the first exciter has a further electrodynamic drive which includes a third part including an oscillator coil and a fourth part including a magnet, the third part being attached to the diaphragm and the fourth part being freely movable in a direction perpendicular to the direction of the extension of the diaphragm.

22. The loudspeaker as claimed in claim 1, wherein the second exciter is adapted to set the diaphragm into a translatory vibrational movement in the direction perpendicular to an extension direction of the diaphragm.

23. The loudspeaker as claimed in claim 4, wherein the other one of the first and second parts of the second exciter is attached to a side of the diaphragm or contacts same to which the first exciter is attached.

* * * * *